United States Patent [19]

Grosick

[11] 4,001,347

[45] Jan. 4, 1977

[54] METHOD FOR THE REMOVAL OF NAPHTHALENE FROM COKE OVEN GAS

[75] Inventor: Herbert A. Grosick, Allison Park, Pa.

[73] Assignee: Koppers Company, Inc., Pittsburgh, Pa.

[22] Filed: Mar. 7, 1974

[21] Appl. No.: 448,959

[52] U.S. Cl. ..... 260/674 N; 202/234; 203/96; 260/674 R

[51] Int. Cl.[2] ..... C07C 7/00

[58] Field of Search ..... 55/48; 203/87, 91–99; 208/184, 185, 363, 365; 210/48, 71; 260/674 R, 674 N

[56] References Cited

UNITED STATES PATENTS

| | | | |
|---|---|---|---|
| 2,129,787 | 9/1938 | Schmalenbach | 260/674 R |
| 2,389,172 | 11/1945 | Van der Hoeven et al. | 260/674 R X |
| 2,649,403 | 8/1953 | Eaton | 260/674 R |
| 2,649,404 | 8/1953 | Reynolds | 260/674 N X |
| 2,710,663 | 6/1955 | Wilson, Jr. | 55/48 |
| 2,810,450 | 10/1957 | Hartmann | 260/674 N X |
| 2,922,751 | 1/1960 | Helm | 208/363 X |
| 3,303,127 | 2/1967 | Potts et al. | 208/363 X |
| 3,581,472 | 6/1971 | Grosick | 55/48 |
| 3,791,965 | 2/1974 | Fitzsimons | 208/184 X |

*Primary Examiner*—Frank A. Spear, Jr.
*Assistant Examiner*—Richard W. Burks
*Attorney, Agent, or Firm*—Sherman H. Barber; Oscar B. Brumback

[57] ABSTRACT

A method for decreasing the naphthalene concentration in debenzolized light oil for greater naphthalene removal comprises pumping the primary light oil condensate and oil bled from a naphthalene scrubber or oil type final cooler to a level above the topmost additional tray in the top portion of a wash oil still.

1 Claim, 1 Drawing Figure

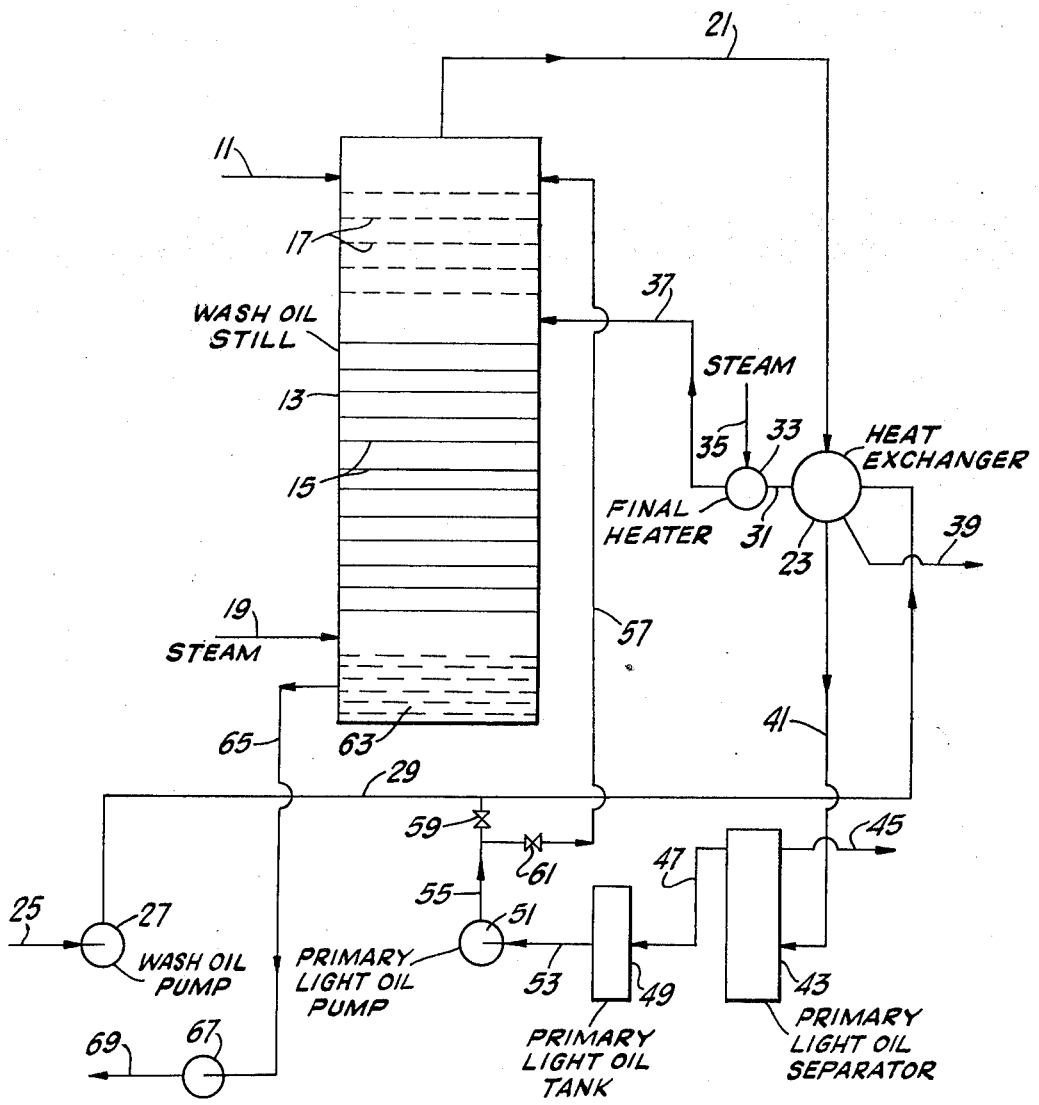
21
11
17
WASH OIL
STILL
13
15
19
STEAM
65
63
29
37
STEAM
35
33
HEAT
EXCHANGER
FINAL
HEATER
31
23
39
57
41
59
61
45
47
55
51
25
27
WASH OIL
PUMP
PRIMARY
LIGHT OIL
PUMP
53
49
43
PRIMARY
LIGHT OIL
TANK
PRIMARY
LIGHT OIL
SEPARATOR
69
67

METHOD FOR THE REMOVAL OF NAPHTHALENE FROM COKE OVEN GAS

BACKGROUND OF THE INVENTION

The present invention relates to coke ovens generally and, more particularly, to the recovery of naphthalene from coke oven by-product gas.

In a conventional light oil recovery plant, the oil condensate from the vapor to oil heat exchanger (primary light oil) is usually returned to the benzolized wash oil stream of the wash oil still. This minimizes the loss of wash oil and does not normally cause a significant increase in the naphthalene concentration in the debenzolized wash oil.

Such practice is carried out in plants in which a naphthalene scrubber or oil type final cooler is used in conjunction with the light oil plant. Frequently, an additional rectifying section is added to the still which strips only the naphthalene rich oil from the naphthalene scrubber or oil type final cooler with the total vapors from the wash oil still. Such practice greatly improves the removal of naphthalene.

The method of operation normally recovers about three times the amount of naphthalene removed in a conventional light oil recovery plant. For this reason, the wash oil condensed in the vapor to oil heat exchanger, which is in equilibrium with the vapor leaving the heat exchanger, contains approximately three times the concentration of naphthalene which this condensate from conventional equipment would contain. Calculations indicate a concentration of 15 to 18% naphthalene in this condensed wash oil. Even though the amount of this condensed wash oil is small, calculations indicate that the concentration of naphthalene in the debenzolized oil is increased approximately 0.4%. This value can be even higher if there is a significant mechanical carry-over from the wash oil still. This higher concentration of naphthalene in the debenzolized wash oil means a higher concentration of naphthalene in the debenzolized gas, with attendant problems due to plugging of the subsequent piping and equipment.

How the method of the present invention minimizes the naphthalene content of the debenzolized gas will be evident to those skilled in the art from the following description and drawing.

SUMMARY OF THE INVENTION

Primary light oil along with oil bled from a naphthalene scrubber or oil type final cooler is introduced into the top portion of a wash oil still.

For a further understanding of the invention and for features and advantages thereof, reference may be made to the following description and the drawing which illustrates a flow diagram of a system in accordance with the invention which is suitable for practicing the method of the invention.

BRIEF DESCRIPTION OF THE DRAWING

The drawing illustrates a flow diagram of an improved system for the removal of naphthalene from coke even gas in accordance with the present invention.

DETAILED DESCRIPTION

Referring to the drawing, oil from a naphthalene scrubber (not shown) flows in conduit 11 into a conventional wash oil still 13 which includes a group of twelve normal trays 15 for the stripping of light oil, and a group of five additional trays 17, above the normal trays 15, for the stripping of naphthalene. Steam enters the wash oil still 13 through conduit 19 about where shown in the drawing.

Oil vapors emerge from the top of the wash oil still 13 through conduit 21 and flow into a heat exchanger 23. Likewise, wash oil from conventional benzol washers flow in conduit 25 into a wash oil pump 27 which urges the wash oil through conduit 29 into the heat exchanger 23. The wash oil passes through the heat exchanger and flows therefrom in conduit 31 into a final heater 33 into which steam flows through conduit 35. From the final heater 33, the wash oil flows in conduit 37 into the wash oil still 13, at a location between the additional trays 17 and the normal trays 15.

Vapors are removed from the heat exchanger 23 and they flow in conduit 39 to a light oil rectifier (not shown). Also, primary light oil and condensed water flows from the heat exchanger 23 through conduit 41 into a primary light oil separator 43, from which water flows in conduit 45 to a suitable sump-type receptacle (not shown).

The primary light oil leaves the light oil separator 43 in conduit 47 and flows into a primary light oil tank 49. From the primary light oil tank 49, light oil is drawn by a primary light oil pump 51 through conduit 53 and is discharged from the pump 51 through a conduit 55 into either one of two conduits 29 or 57. Valve 59 in conduit 55 and valve 61 in conduit 57 control the flow of primary light oil from the primary light oil pump 51.

In accordance with the invention, the valve 59 is normally closed so that the light oil flows from the pump 51 through conduit 57 into the top portion of the wash oil still 13; entering at a level above the uppermost additional tray 17 in the still, as shown in the drawing.

Wash oil 63 collects in the bottom of the wash oil still 13 and is removed therefrom through conduit 65 connected to the suction of a wash oil pump 67. The wash oil pump 67 urges the wash oil through conduit 69 toward conventional wash oil coolers (not shown).

From the foregoing description of a system in accordance with the invention, which is suitable for practicing the method of the invention, those skilled in the art should recognize many important features and advantages thereof, among which the following are particularly significant:

That, by pumping primary light oil along with oil bled from a naphthalene scrubber or oil type final cooler to a level above the topmost additional tray of a wash oil still, the recycled naphthalene is kept out of the wash oil that flows to the benzol washers, whereby the naphthalene content of the debenzolized gas is a minimum; and That, by so directing the primary light oil, with the resultant minimizing of the naphthalene content of the debenzolized gas, conventional problems of plugging of piping and equipment with naphthalene are practically eliminated.

Although the invention has been described herein with a certain degree of particularity, it is understood that the present disclosure has been made only as an example and that the scope of the invention is defined by what is hereinafter claimed.

What is claimed is:

1. A system for removing naphthalene from coke oven gas comprising:

a. a wash oil still wherein there are a plurality of normal first trays and in spaced apart relation thereabove a plurality of additional second trays;
b. a conduit carrying oil from a naphthalene scrubber into the top portion of said still at a level above the topmost second tray;
c. a conduit carrying light oil vapors from said still to a heat exchanger from which a conduit carries vapors to a light oil rectifier;
d. a conduit carrying light oil from said heat exchanger to a primary light oil separator;
e. a conduit carrying steam into said still;
f. a conduit carrying wash oil from benzol washers into said heat exchanger;
g. a conduit carrying said wash oil from said heat exchanger to and into said wash oil still at a level between said first and second sets of trays;
h. a conduit carrying primary light oil from said separator into a primary light oil tank and thence into said wash oil still at a level above said topmost second tray; and
i. a conduit carrying wash oil away from said still.

* * * * *